US011467513B2

(12) United States Patent
Tamaki et al.

(10) Patent No.: US 11,467,513 B2
(45) Date of Patent: Oct. 11, 2022

(54) IMAGE FORMING APPARATUS

(71) Applicant: KYOCERA Document Solutions Inc., Osaka (JP)

(72) Inventors: Tomohiro Tamaki, Osaka (JP); Takahisa Nakaue, Osaka (JP); Kotatsu Kawaguchi, Osaka (JP); Masahito Ishino, Osaka (JP); Yukari Ota, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/486,021

(22) Filed: Sep. 27, 2021

(65) Prior Publication Data

US 2022/0107584 A1 Apr. 7, 2022

(30) Foreign Application Priority Data

Oct. 2, 2020 (JP) ..... JP2020-167480

(51) Int. Cl.
*G03G 15/06* (2006.01)
*G03G 15/08* (2006.01)
*G03G 15/02* (2006.01)

(52) U.S. Cl.
CPC ..... *G03G 15/0812* (2013.01); *G03G 15/0266* (2013.01); *G03G 15/065* (2013.01); *G03G 15/0818* (2013.01)

(58) Field of Classification Search
CPC ..... G03G 15/0266; G03G 15/065; G03G 15/0812; G03G 15/0818
USPC ..... 399/56, 55
See application file for complete search history.

(56) References Cited

FOREIGN PATENT DOCUMENTS

EP 0401020 A2 * 12/1990
JP 2001-175075 A 6/2001

* cited by examiner

*Primary Examiner* — Hoan H Tran
(74) *Attorney, Agent, or Firm* — Studebaker & Brackett PC

(57) ABSTRACT

An image forming apparatus includes an image carrier, a charger, an exposure device, a development device and a pressing mechanism. The developer carrier is pressed on the image carrier with a predetermined pressing force to form a nip area between the roller part and the image carrier. A roller part of the developer carrier has an Asker C hardness of 65° or more and 73° or less. When the pressing force is set to X (N) and a width of the nip area in a circumferential direction of the image carrier is set to Y (μm), 3.0≤X≤8.0 and 550≤Y≤700, and the following expressions (1) and (2) are satisfied, $$Y \geq 31.0X + 393.2 \quad (1)$$

and, $$Y \leq 47.0X + 450.1. \quad (2)$$

9 Claims, 8 Drawing Sheets

IMAGE FORMING APPARATUS

INCORPORATION BY REFERENCE

This application is based on and claims the benefit of priority from Japanese patent application No. 2020-167480 filed on Oct. 2, 2020, which is incorporated by reference in its entirety.

BACKGROUND

The present disclosure relates to an image forming apparatus using an electrophotographic process, such as a copy machine, a printer and a facsimile, and more particularly, to an image forming apparatus provided with a non-magnetic one-component development type development device.

As the development device used in the image forming apparatus using the electrophotographic process, such as a copy machine, a printer, a facsimile and a multifunctional peripheral, a two-component development type employing a toner and a carrier as a developer and a one-component development type employing a toner only without using a carrier are known.

In the development device of the non-magnetic one-component development type, the toner is conveyed by fine concave and convex formed on a surface of a development roller, and excessive toner is regulated by a regulating blade to form a toner thin layer. In addition, when the toner passes below the regulating blade, the toner is charged by friction with the surface of the development roller. Then, a photosensitive drum is rotated with coming into contact with the development roller, and the toner on the surface of the development roller is supplied to the photosensitive drum by electric field.

The non-magnetic one-component development type eliminates the need of devices such as a magnet, a metal sleeve and the carrier, which are necessary for the two-component development type, and allows to perform a sufficient development using only a DC voltage. That is, a stable development performance can be obtained with a simple and low-cost configuration, so that the non-magnetic one-component development type is positively adopted for a low-speed compact machine mainly.

In the above-described non-magnetic one-component development type, a development voltage is adjusted such that a target image density is obtained and a cleaning failure does not occur. Because the image density is determined based on a relationship between a potential of the photosensitive drum after exposure and a development voltage and the cleaning failure is determined based on a relationship between a surface potential of the photosensitive drum and the development voltage, the development voltage has a usable range (OW) where the target density is secured and the cleaning failure does not occur. Considering variation in the surface potential of the photosensitive drum, toner deterioration and variation in development sensitivity due to environment (a humidity and a temperature), the usable range (OW) requires to have a predetermined width (about 120 V). In the non-magnetic one-component development type, it is important how widely the OW can be obtained.

Therefore, there has been proposed a method of reducing the cleaning failure while securing the target density. For example, there is a configuration in which a ratio P/δ of a contact force P of a toner carrier to an electrostatic latent image carrier per unit length with respect to a deformation amount δ of the surface of the electrostatic latent image carrier or the surface of the toner carrier in the contact direction is set to 2 to 200. Specifically, the contact force P is set to 1 gf/mm or more, and a contact width (a nip width) S in the direction perpendicular to the predetermined length range is set to 2 mm or more.

In the above configuration, the nip width, the nip pressure, and the deformation amount of the development roller are defined, and the range of the nip width is set to 2 mm or more. However, when the development roller of high hardness having a nip width of 2 mm or less is used, the nip pressure tends to be too high to obscure a contour of a dot image. Therefore, the configuration is not suitable for the development roller of high hardness.

SUMMARY

In accordance with an aspect of the present disclosure, an image forming apparatus includes an image carrier, a charger, an exposure device, a development device and a pressing mechanism. The image carrier has a surface on which a photosensitive layer is formed. The charger charges the image carrier at a predetermined surface potential. The exposure device exposes the surface of the image carrier charged by the charger and attenuates the surface potential to form an electrostatic latent image. The development device includes a development container, a developer carrier and a regulating blade. The development container contains a non-magnetic one-component developer consisting of a toner only. The developer carrier includes a roller part which carries the toner on an outer circumferential surface and a rotational shaft disposed along an axial center of the roller part, and is pressed on the image carrier with a predetermined pressing force to form a nip area between the roller part and the image carrier. The regulating blade comes into contact with the outer circumferential surface of the roller part of the developer carrier to regulate a thickness of a toner layer formed on the outer circumferential surface of the roller part. The development device is configured to supply the toner to the image carrier on which the electrostatic latent image is formed. The pressing mechanism presses the development container close to the image carrier. The roller part of the developer carrier has an Asker C hardness of 65° or more and 73° or less. When the pressing force is set to X (N) and a width of the nip area in a circumferential direction of the image carrier is set to Y (μm), $3.0 \leq X \leq 8.0$ and $550 \leq Y \leq 700$, and the following expressions (1) and (2) are satisfied, $$Y \geq 31.0X + 393.2 \quad (1)$$

and, $$Y \leq 47.0X + 450.1. \quad (2)$$

The other features and advantages of the present disclosure will become more apparent from the following description. In the detailed description, reference is made to the accompanying drawings, and preferred embodiments of the present disclosure are shown by way of example in the accompanying drawings.

BRIEF DESCRIPTION OF THE DRAWINGS

DETAILED DESCRIPTION (1. Entire Structure of Image Forming Apparatus 1) Hereinafter, with reference to the attached drawings, one embodiment in the present disclosure will be described. FIG. 1 is a sectional side view schematically showing a structure of an image forming apparatus 1 according to the embodiment of the present disclosure. The right side in FIG. 1 is defined as a front side of the image forming apparatus 1 and the left side in FIG. 1 is defined as a rear side of the image forming apparatus 1.

Figure 1:
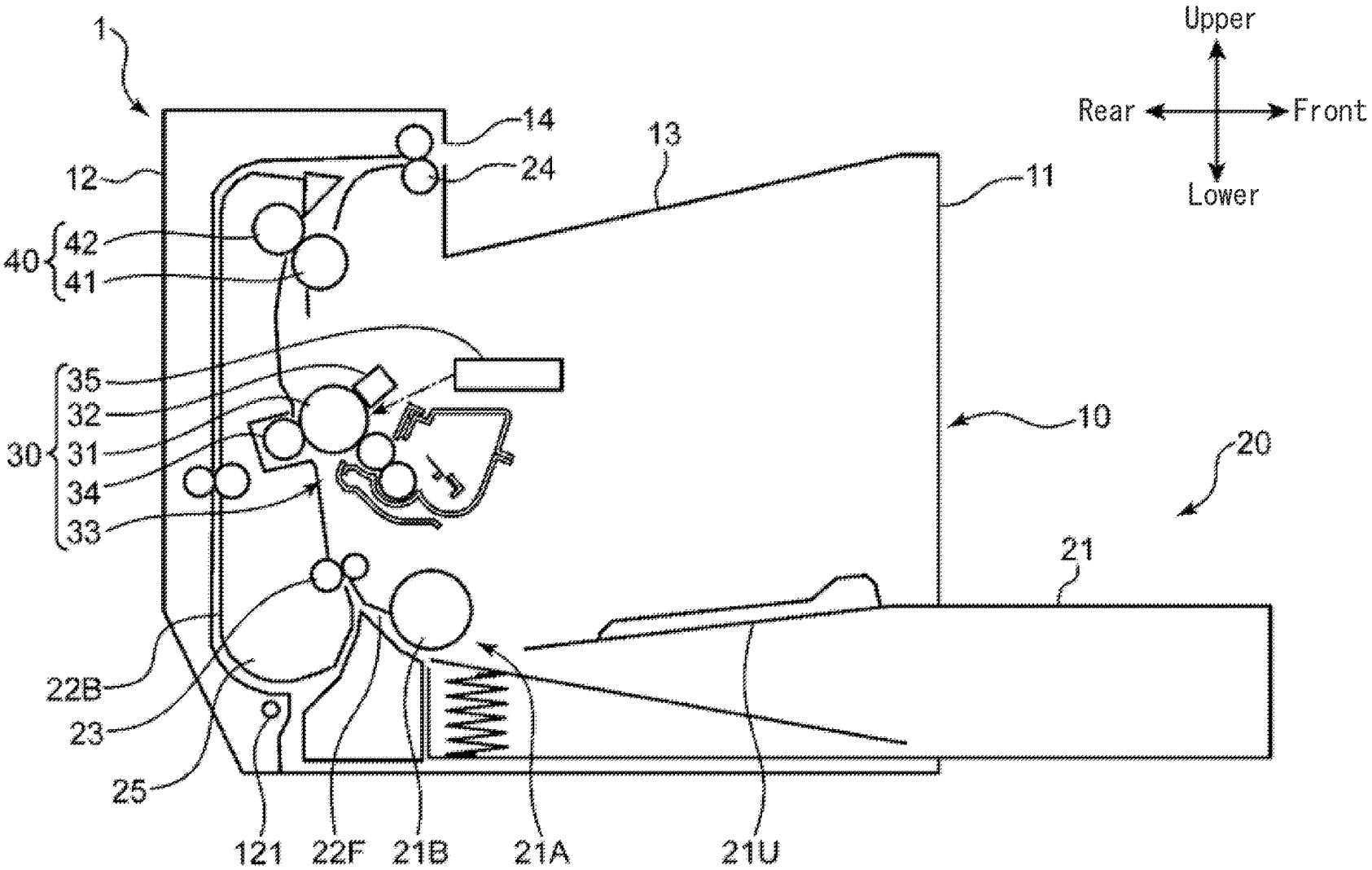
FIG. 1 is a side sectional view schematically showing a structure of an image forming apparatus 1 according to one embodiment of the present disclosure.

The image forming apparatus 1 (a monochrome printer, in this embodiment) includes a main body housing 10 having a housing structure of a substantially rectangular parallelepiped shape, a sheet feeding part 20, an image forming part 30, and a fixing part 40 which are housed in the main body housing 10. A front cover 11 is provided on the front surface of the main body housing 10, and a rear cover 12 is provided on the rear surface of the main body housing 10. Each unit of the image forming part 30 and the fixing part 40 can be attached to and detached from the rear surface side of the main body housing 10 by opening the rear cover 12. On the upper surface of the main body housing 10, a sheet discharge part 13 which discharges the image formed sheet is provided. In the following description, the term "sheet" refers to a copy paper, a coated paper, an OHP sheet, a thick paper, a postcard, a tracing paper, and other sheet materials on which an image forming processing is performed.

The sheet feeding part 20 includes a sheet feeding cassette 21 in which the sheet on which the image forming processing is to be performed is stored. A part of the sheet feeding cassette 21 protrudes further forward from the front surface of the main body housing 10. The upper surface of the sheet feed cassette 21 housed in the main body housing 10 is covered with a sheet feeding cassette top plate 21U. The sheet feeding cassette 21 is provided with a sheet storage space in which a bundle of the sheets is stored, a lift plate which lifts up the bundle of sheets and feeds it, and the others. Above the rear end portion of the sheet feeding cassette 21, a sheet feeding part 21A is provided. In the sheet feeding part 21A, a sheet feeding roller 21B which feeds the uppermost sheet of the bundle of sheets in the sheet feeding cassette 21 one by one is disposed.

The image forming part 30 performs the image forming processing which forms a toner image (a developer image) on the sheet fed from the sheet feeding part 20. The image forming part 30 includes a photosensitive drum 31, a charger 32, an exposure part 35, a development part 33 and a transfer roller 34 which are disposed around the photosensitive drum 31.

The photosensitive drum 31 (an image carrier) includes a rotational shaft and an outer circumferential surface (a drum body) rotating around the rotational shaft. The photosensitive drum 21 is made by, for example, a known organic photosensitive member (OPC), and around the outer circumferential surface of the photosensitive drum 31, a photosensitive layer including a charge generating layer, a charge transporting layer, and the others is formed. The photosensitive layer is uniformly charged by the charger 32 described later, and then is irradiated with light by the exposure part 35 to attenuate the surface potential and to form an electrostatic latent image. Then, on the photosensitive layer, a toner image in which the electrostatic latent image is developed by the development part 33 is carried.

Figure 2:
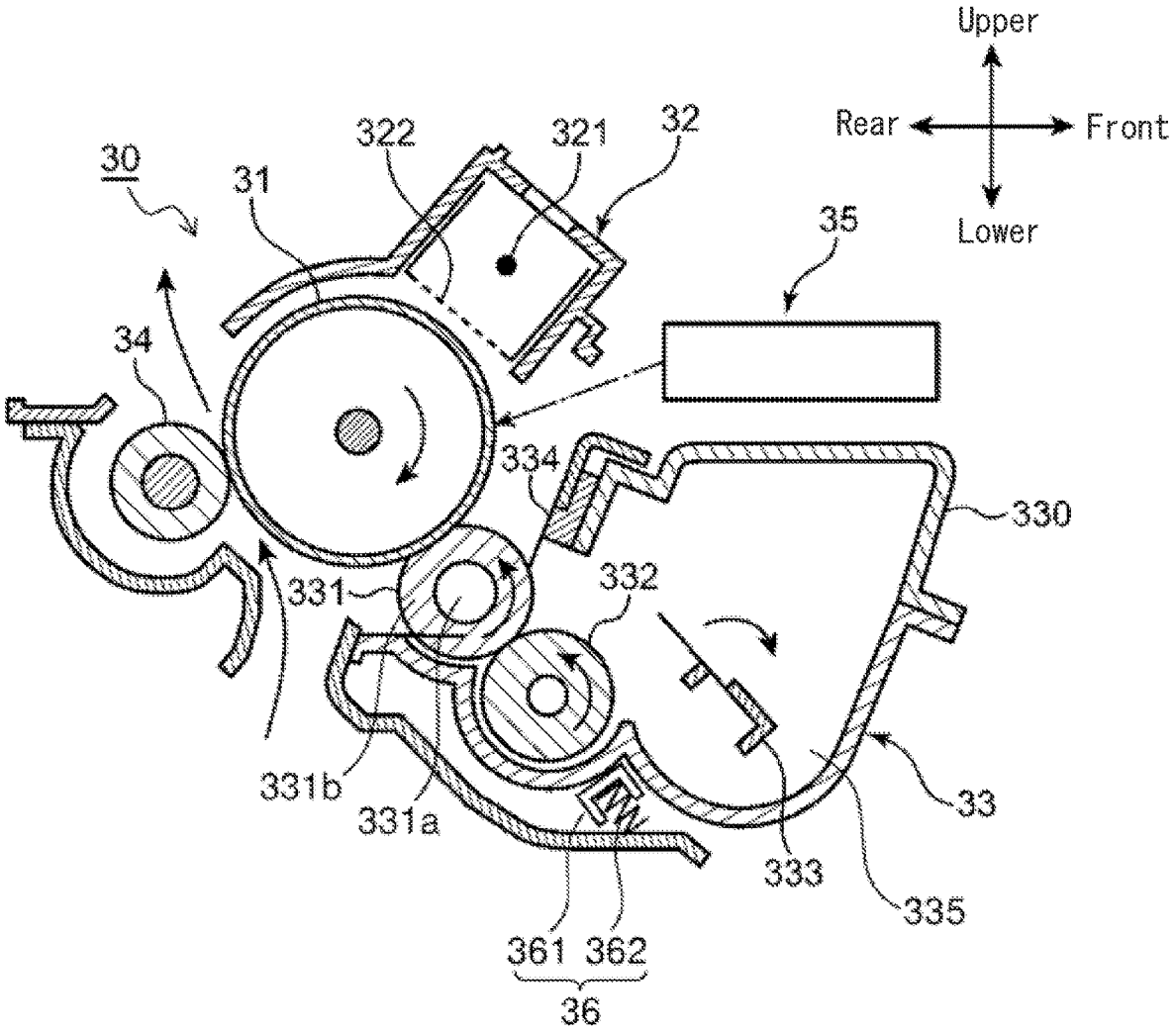
FIG. 2 is a side sectional view schematically showing a structure of an image forming part 30 of the image forming apparatus 1 according to the present embodiment.

The charger 32 (a charging device) is disposed at a predetermined interval with respect to the outer circumferential surface of the photosensitive drum 31, and uniformly charges the outer circumferential surface of the photosensitive drum 31 in a non-contact state. Specifically, the charger 32 includes a charge wire 321 and a grid electrode 322 (both are shown in FIG. 2). The charge wire 321 is a linear electrode extending in the rotational axis direction of the photosensitive drum 31, and generates corona discharge between the charge wire 321 and the photosensitive drum 31. The grid electrode 322 is a grid-like electrode extending in the rotational axis direction of the photosensitive drum 31, and is disposed between the charge wire 321 and the photosensitive drum 31. The charger 32 generates the corona discharge by flowing a current of a predetermined current value through the charge wire 321, and charges the outer circumferential surface of the photosensitive drum 31 facing the grid electrode 322 to a predetermined surface potential uniformly by applying a predetermined voltage to the grid electrode 322.

The exposure part 35 (an exposure device) includes a laser light source and optical elements such as a mirror and a lens, and irradiates the light modulated based on image data output from an external device, such as a personal computer, on the outer circumferential surface of the photosensitive drum 31. Then, the exposure part 35 forms the electrostatic latent image corresponding to an image based on the image data on the outer circumferential surface of the photosensitive drum 31.

The development part 33 (the development device) is attachable to and detachable from the main body housing 10, and supplies a non-magnetic one-component toner (a developer) to the outer circumferential surface of the photosensitive drum 31 to develop the electrostatic latent image formed on the outer circumferential surface of the photosensitive drum 31. The developing the electrostatic latent image means that a toner image (a developer image) in which the electrostatic latent image is made visible is formed. The development part 33 will be described later in detail.

The transfer roller 34 is a roller which transfers the toner image formed on the outer circumferential surface of the photosensitive drum 31 to the sheet. Specifically, the transfer roller 34 has an outer circumferential surface rotating around an axis and facing the outer circumferential surface of the photosensitive drum 31 on the downstream side of the development roller 331 in the rotational direction of the photosensitive drum 31. The transfer roller 34 transfers the toner image carried on the outer circumferential surface of the photosensitive drum 31 to the sheet passed through a nip area between the transfer roller 34 and the outer circumferential surface of the photosensitive drum 31. At the transferring, the transfer toiler 34 is applied with a transfer voltage having a polarity opposite to the toner.

The fixing part 40 performs a fixing processing in which the toner image transferred to the sheet is fixed on the sheet. The fixing part 40 includes a fixing roller 41 and a pressure roller 42. The fixing roller 41 includes a heat source housed therein, and heats the toner transferred to the sheet at a predetermined temperature. The pressure roller 42 is brought into pressure contact with the fixing roller 41 to form a fixing nip area between the fixing roller 41 and the pressure roller 42. When the sheet to which the toner image is transferred is passed through the fixing nip area, the toner image is heated by the fixing roller 41 and pressed by the pressure roller 42 to be fixed on the sheet.

Inside the main body housing 10, a main conveyance path 22F and an inversion conveyance path 22B along which the sheet is conveyed are provided. The main conveyance path 22F extends from the sheet feeding part 21A of the sheet feeding part 20 to a sheet discharge port 14 provided facing the sheet discharge part 13 provided on the upper surface of the main body housing 10 via the image forming part 30 and the fixing part 40. The inversion conveyance path 22B is a conveyance path for returning the sheet formed with the image on one surface to the upstream side of the image forming part 30 on the main conveyance path 22F when the both-side printing is performed on the sheet.

The main conveyance path 22F is extended such that the sheet is conveyed through the transfer nip area between the photosensitive drum 31 and the transfer roller 34 from the lower side to the upper side. On the main conveyance path 22F, a registration rollers pair 23 is disposed on the upstream side of the transfer nip area. The sheet is stopped by the registration rollers pair 23, and then fed to the transfer nip area at a predetermined timing for the image transferring after the skew of the sheet is corrected. At suitable positions on the main conveyance path 22F and the inversion conveyance path 22B, a plurality of conveyance rollers for conveying the sheet is disposed. Near the sheet discharge port 14, a discharge rollers pair 24 is disposed.

The inversion conveyance path 22B is formed between the outer surface of an inversion unit 25 and the inner surface of the rear cover 12 of the main body housing 10. On the inner surface of the inversion unit 25, the transfer roller 34 and one roller of the registration rollers pair 23 are mounted. The rear cover 12 and the inversion unit 25 are rotatable around the supporting point 121 provided in the lower portions thereof. When the sheet jamming occurs on the inversion conveyance path 22B, the rear cover 12 is opened. When the sheet jamming occurs on the main conveyance path 22F, or when the unit of the photosensitive drum 31 or the development part 33 is detached outside, the inversion unit 25 is opened together with the rear cover 12.

Figure 3:
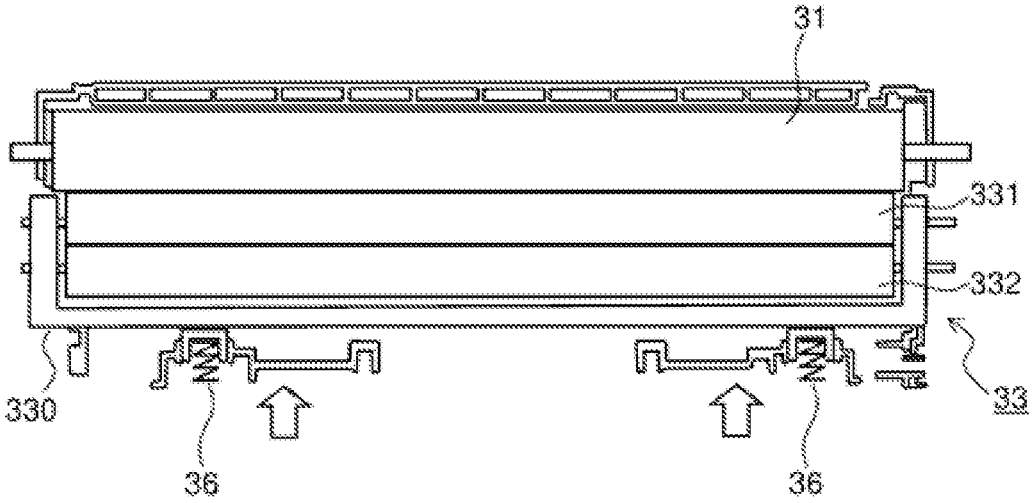
FIG. 3 is a plan view showing a contact area between a photosensitive drum 31 and a development roller 331 of a development part 33 viewed from the upper side.

(2. Structure of Image forming Part 30) FIG. 2 is a sectional view showing the image forming part 30 in the image forming apparatus 1 of the present embodiment. FIG. 3 is a plan view showing a contact area between the photosensitive drum 31 and the development roller 331 of the development part 33 viewed from the upper side. FIG. 3 is an enlarged sectional view showing a contact area between the development roller 331 and the regulating blade 334 in the development part 33.

As shown in FIG. 2 and FIG. 3, the development part 33 includes a development housing 330 (a development container), the development roller 331 (a developer carrier), a supply roller 332, an agitating paddle 333 and the regulating blade 334.

The development housing 30 contains a non-magnetic one-component developer consisting of a toner only, and the development roller 331, the supply roller 332 and the regulating blade 334 are stored in the development housing 30. The development housing 330 includes an agitating room 335 in which the developer in an agitated state is contained.

The agitating room 335 contains the non-magnetic one-component developer in an agitated state. In the agitating room 335, the agitating paddle 333 is disposed. The agitating paddle 335 agitates the developer supplied to the agitating room 335 by a toner supply device (not shown).

The development roller 331 has a rotational shaft 331*a* and a roller part 331*b*. The rotational shaft 331*a* is supported by the development housing 330 with bearings (not shown) in a rotatable manner. The roller part 331*b* is a cylindrical member provided around the outer circumferential surface of the rotational shaft 331*a*, and has a configuration that a coating layer is laminated on a surface of a base rubber (for example, silicone rubber) with an uneven coating material such as urethane. The roller part 331*b* is rotated together with the rotational shaft 331*a* with the rotation of the rotational shaft 331*a*. On the surface of the roller part 331*b*, a toner layer (a developer layer) of a predetermined thickness is formed. The thickness of the toner layer is regulated by the regulating blade 334 as described later (regulated uniformly at a predetermined thickness). The toner layer is charged by static electricity generated by contact with the regulating blade 334.

The development roller 331 is rotated in a direction from the upstream side to the downstream side (the counterclockwise direction in FIG. 2) in the rotational direction (the clockwise direction in FIG. 2) of the photosensitive drum 31 at a position facing the photosensitive drum 31. That is, the development roller 331 is rotated in the same direction as the photosensitive drum 31 at the position facing the photosensitive drum 31.

The supply roller 332 is disposed facing the development roller 331. The supply roller 332 carries the developer contained in the agitating room 335 on its outer circumferential surface. In addition, the supply roller 332 supplies the developer carried on the outer circumferential surface to the development roller 331.

The supply roller 332 is rotated in a direction from the downstream side to the upstream side (the counterclockwise direction in FIG. 2) in the rotational direction (the counterclockwise direction in FIG. 2) of the development roller 331 at a position facing the development roller 331. That is, the supply roller 332 is rotated in an opposite direction to the development roller 331 at the position facing the development roller 331.

The development roller 331 is supplied with the developer from the supply roller 332 and carries the toner layer on the outer circumferential surface. Then, the development roller 331 supplies the developer to the photosensitive drum 31. The lengths of the development roller 331 and the supply roller 332 in the axial direction (a direction perpendicular to the paper surface on which FIG. 2 is drawn) is substantially the same as the length of the photosensitive drum 31 in the axial direction. In order to efficiently move the toner from the development roller 331 to the photosensitive drum 31, a predetermined development voltage is preferably applied to the development roller 331.

In the image forming part 30, a pressing mechanism 36 including a pressing member 361 and a pressing spring 362 is disposed on the opposite side (the right lower side in FIG. 2 and the lower side in FIG. 3) to the photosensitive drum 31 with respect to the development housing 330. The pressing mechanisms 36 are disposed at two positions in the longitudinal direction of the development housing 330 (positions separated from the axial center of the photosensitive drum 31 on the both sides by 85 mm respectively). When the development part 33 is attached to the image forming part 30, the pressing member 361 is pressed against the development housing 330 in a direction close to the photosensitive drum 31 (the left upper direction in FIG. 2 and the upper direction in FIG. 3), and the development roller 331 is pressed against the photosensitive drum 31 with a predetermined pressing force. In the development part 33 and the photosensitive drum 31, there is no mechanism for regulating a distance between the development roller 331 and the photosensitive drum 31, that is, a mechanism for regulating the pressing force of the development roller 331 against the photosensitive drum 31.

The regulating blade 334 is a thin metal member. The regulating blade 334 is configured such that the proximal end portion 334*a* is fixed to the development housing 330 and the distal end portion 334*b* is a free end. The regulating blade 334 comes into contact with the outer circumferential surface of the development roller 331 at a position upstream of a position where the photosensitive drum 31 and the development roller 331 face each other in the rotational direction of the development roller 331.

The regulating blade 334 is flexibly deformable, and there is a contact area (a nip area) between the regulating blade 334 and the development roller 331 in the circumferential direction of the development roller 331. The regulating blade 334 comes into contact with the outer circumferential surface of the development roller 331 (the roller part 331*a*) with a predetermined regulating pressure and a nip width W.

The material of the regulating blade 334 is SUS 304 and the free length is 10 mm. The tip end portion 334*a* of the regulating blade 334 is subjected to a bending to form a curved part 334*c*. The curved part 334*c* comes into contact with the outer circumferential surface of the development roller 331. A radius of curvature of the curved part 334*c* is 0.1 mm or more.

Figure 4:
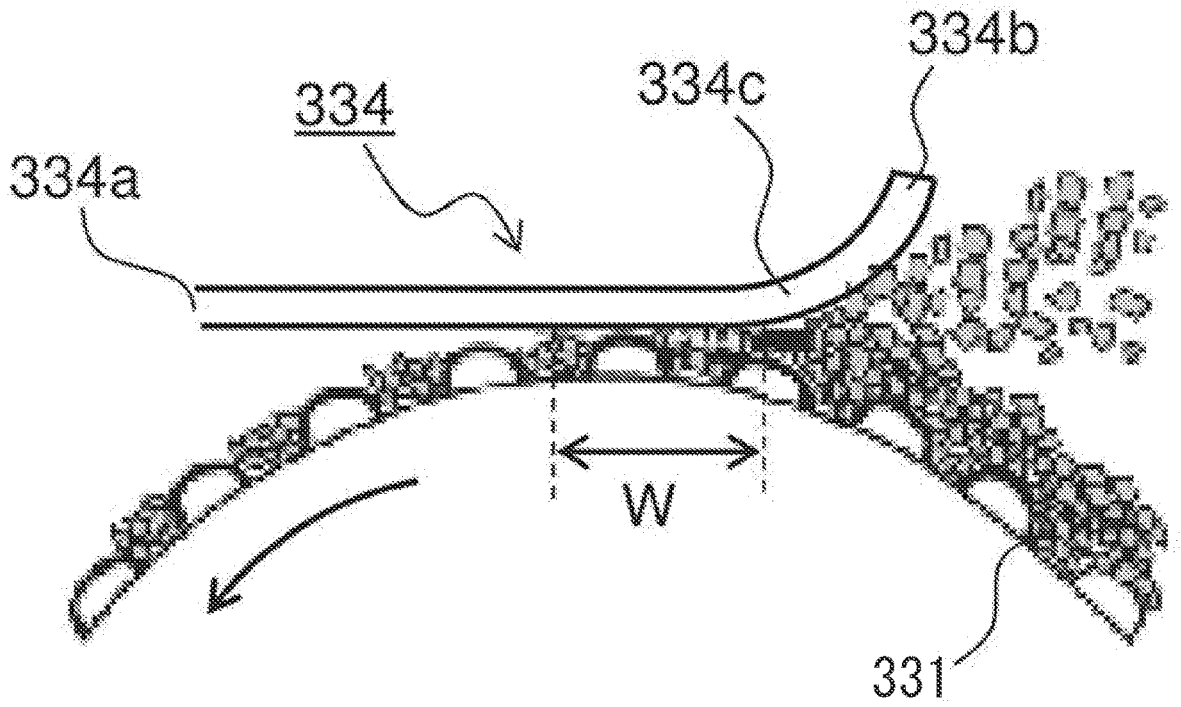
FIG. 4 is an enlarged sectional view showing a contact area between the development roller 331 and a regulating blade 334 in the development part 33.

As shown in FIG. 4, because the regulating blade 334 comes into contact with the development roller 331 with a predetermined regulating pressure (a line contact pressure), the toner layer carried on the outer circumferential surface of the development roller 331 is regulated to have a uniform thickness. Thus, the regulating blade 334 regulates an amount of the toner carried on the outer circumferential surface of the development roller 331. Further, the regulating blade 334 is rubbed against the toner carried on the outer circumferential surface of the development roller 334 to charge the toner. The linear contact pressure of the regulating blade 334 on the outer circumferential surface of the development roller 331 is a contact pressure of the regulating blade 334 per unit length at the contact area between the regulating blade 334 and the outer circumferential surface of the development roller 331.

(3. Structure of Development Roller 331) Hereinafter, a hardness of the development roller 331, a pressing force of the development roller 331 to the photosensitive drum 31 and a nip width (a contact width in the circumferential direction) between the photosensitive drum 31 and the development roller 331, which are characteristic features in the image forming apparatus 100 of the present embodiment, will be described. As described above, occurrence of the white void in the image and the cleaning failure is in close contact with the hardness of the development roller 331, the pressing force of the development roller 331 to the photosensitive drum 31 and the nip width.

Figure 5:
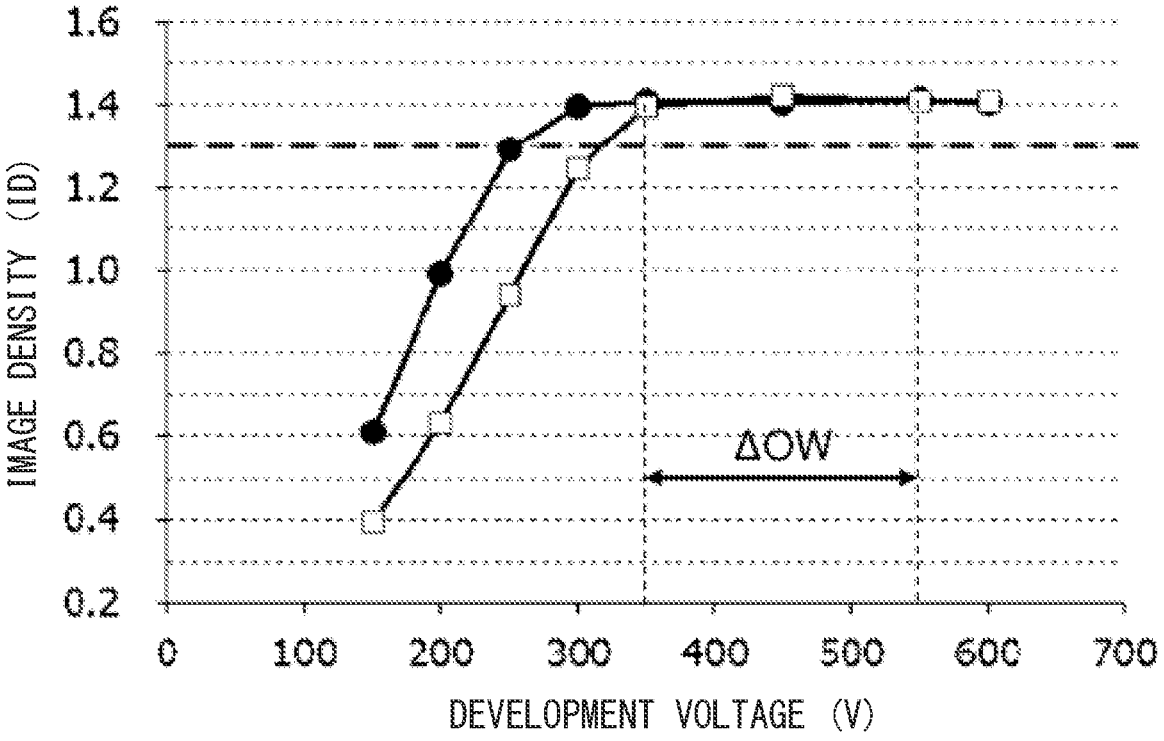
FIG. 5 is a graph showing a relationship between a development voltage applied to the development roller 331 and an image density.

FIG. 5 is a graph showing a relationship (a development sensitivity characteristic) between a development voltage applied to the development roller 331 and an image density (ID). In FIG. 5, the toner at the initial usage is represented by ●, and the toner after the durability test and environmental variation (variation to a high temperature and high humidity environment) is represented by □. As shown in FIG. 5, when the development voltage Vdc is equal to or lower than a predetermined value (350 V), the target image density (ID=1.3) cannot be obtained after the durability test and the environmental variation. On the other hand, when the development voltage Vdc is equal to or higher than a predetermined value (550 V), a toner collection failure from the photosensitive drum 31 occurs, causing the cleaning failure. A usable range OW is in a range of 350 V or more and 550 V or less, and ΔOW=550−350=200 V, and ΔOW of 120 V or more can be ensured.

Figure 6:
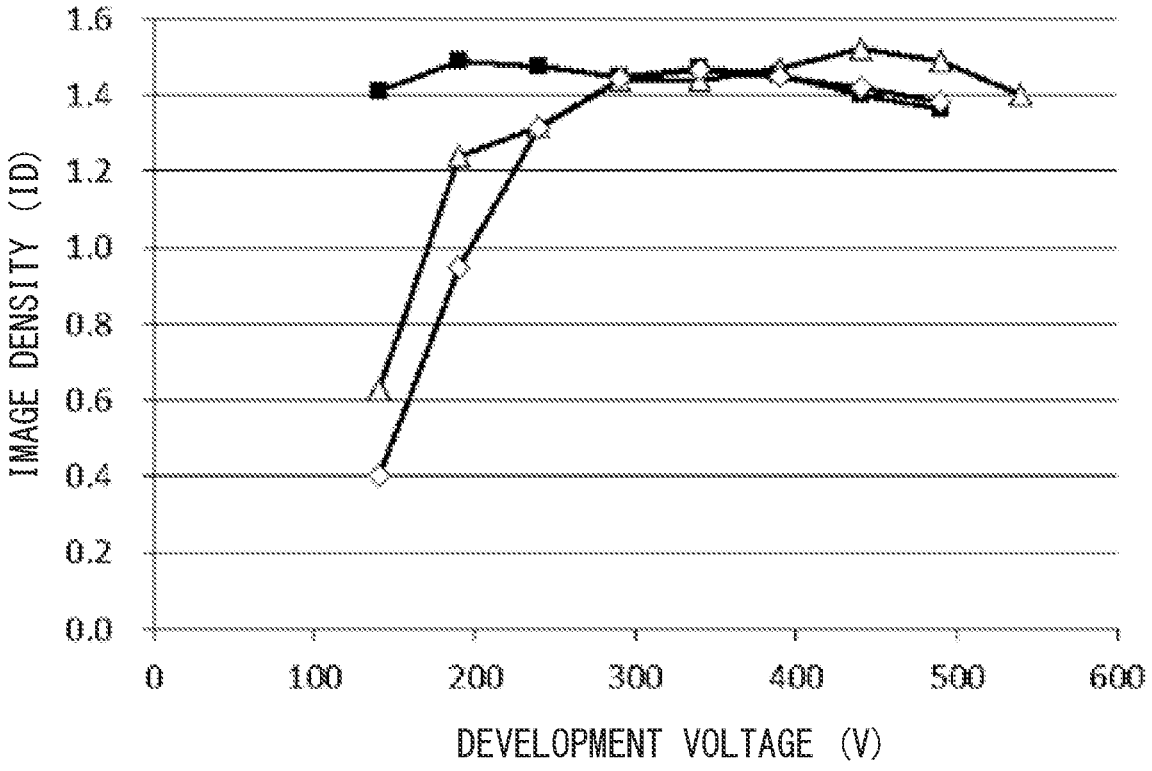
FIG. 6 is a graph showing a relationship between a development voltage and an image density when a pressing force of the development roller 331 to the photosensitive drum 31 is changed.

FIG. 6 is a graph showing a relationship between a development voltage and an image density (ID) when a 100% solid image is formed while varying the pressing force of the development roller 331 on the photosensitive drum 31. In FIG. 6, a case where the pressing force of the development roller 331 is weak (3 N) is represented by ■, the case where the pressing force is medium (6 N) is represented by Δ, and the case where the pressing force is strong (9 N) is represented by ◇. As shown in FIG. 6, the development performance (a development sensitivity) of the toner is changed depending on the pressing force of the development roller 331. Specifically, if the pressing force of the development roller 331 is too strong, the development sensitivity is lowered, and the white void in the solid image occurs. On the other hand, if the pressing force of the development roller 331 is too weak, the remaining toner on the photosensitive drum 31 cannot be collected, causing the cleaning failure.

In the actual image forming apparatus 100, the pressing force of the development roller 331 on the photosensitive drum 31 can be adjusted by changing a spring load of the pressing spring 362. The attachment position of the pressing spring 362 contains two points, one on the driving side and the other on the counter driving side, so that the pressing force can be easily changed at the axial end portions of the image. If an appropriate spring load is not selected, the above-described white void in the solid image and cleaning failure may occur on the end portions of the image. As described above, the improvement of the robustness against the change of the pressing force leads to a stabilization of image quality.

Then, a relationship between the hardness and the pressing force of the development roller 331 and the occurrence of white void in the image and cleaning failure was checked. As a test method, when the Asker C hardness of the development roller 331 and the spring load of the pressing spring 362 were changed, whether the white void in the image and the cleaning failure occur was checked. The Asker C hardness of the development roller 331 was changed in 5 steps of 55°, 60°, 65°, 70°, and 73°, and the spring load of the pressing spring 362 was changed in 8 steps of 2 to 9 N by 1 N.

In an evaluation method, for the white void in the image, one 25% half-tone image was printed, the image density (ID) was measured by an image density meter (an ID measurement instrument), and when a difference ΔID between the maximum value and the minimum value of the measured value was larger than 0.2, it was determined that the white void in the image occurs. For the cleaning failure, a solid patch image of 20 mm×20 mm was formed at 3 positions containing the left, the center, and the right portions in the axial direction of the development roller 331, and transferred to the sheet, and when toner adhesion was observed on the sheet at a position where the photosensitive drum 31 is rotated by one rotation, it was determined that the cleaning failure occurs.

The development roller 331 has the roller part 331*b* made of a silicone rubber layer having a layer thickness of 3.5 mm coated with urethane as a base material layer and having an outer diameter of 13 mm, an axial length of 232 mm, and a resistance value of 7.1 [log Ω], and the rotational shaft 331*a* having a shaft diameter of 6 mm. The five development rollers 331 (manufactured by NICK) having the Asker C hardness of 55°, 60°, 65°, 70°, and 73° were prepared, and the linear speed of the development roller 331 was set to 195 mm/sec. The Asker C hardness was measured using a constant pressure loader (CL-150, manufactured by Polymer Instruments Inc.). The resistance value was measured by bringing the development roller 311 into contact with a metal roller, rotating it, and applying a DC voltage of 100 V.

The material of the regulating blade 334 is SUS 304 and the free length of the regulating blade 334 is 10 mm. The regulating pressure (the contact line pressure) was adjusted by changing a biting amount of the regulating blade 334 into the development roller 331 and a thickness of the regulating blade 334.

The photosensitive drum 31 was a positively-charged single-layer OPC photosensitive drum (manufactured by Kyocera Document Solutions) having an outer diameter of 24 mm and a photosensitive layer thickness of 22 μm, and a scorotron type corona charger was used for the charger 10.

The toner was a polyester toner having a central particle diameter of 6.8 μm, a circularity of 0.96 and a melt viscosity of 200,000 Pa·s at 90° C., and produced by a pulverization method. The central particle diameter was measured using a particle size distribution meter (LS-230, manufactured by Beckman Coulter). The circularity was measured using a wet type flow particle size and shape analyzer (FPIA-3000, manufactured by Sysmex). The melt viscosity was measured using a flow tester (CFT-500EX, manufactured by Shimadzu Corporation). The results are shown in Table 1, Table 2 and FIG. 7.

TABLE 1

| Spring load | Asker C hardness of Development Roller (°) | | | | |
|---|---|---|---|---|---|
| (N) | 55 | 60 | 65 | 70 | 73 |
| 2 | ○ | ○ | x | x | x |
| 3 | x | ○ | ○ | x | x |
| 4 | x | x | ○ | ○ | x |
| 5 | x | x | ○ | ○ | ○ |
| 6 | x | x | x | ○ | ○ |
| 7 | x | x | x | ○ | ○ |
| 8 | x | x | x | ○ | ○ |
| 9 | x | x | x | x | ○ |

Table 1 shows the occurrence of the white void in the image and the cleaning failure when the Asker C hardness of the development roller 331 and the spring load of the pressing spring 362 were changed. In Table 1, a case where both the white void in the image and the cleaning failure do not occur is represented by ○, and a case where the white void in the image or the cleaning failure occurs is represented by x. From Table 1, it is understood that a suitable spring load is changed depending on the Asker C hardness of the development roller 331, and the higher the hardness of the development roller 331, the wider the range of the spring load where the image failure does not occur.

TABLE 2

| Spring load | Asker C hardness of Development Roller (°) | | | | |
|---|---|---|---|---|---|
| (N) | 55 | 60 | 65 | 70 | 73 |
| 2 | 620 | 580 | 530 | 480 | 460 |
| 3 | 710 | 650 | 590 | 510 | 490 |
| 4 | 790 | 710 | 650 | 550 | 520 |
| 5 | 860 | 770 | 700 | 610 | 550 |
| 6 | 930 | 830 | 730 | 650 | 580 |
| 7 | 980 | 880 | 780 | 670 | 610 |
| 8 | 1040 | 940 | 820 | 700 | 640 |
| 9 | 1100 | 1000 | 840 | 730 | 670 |

Table 2 shows the nip width between the development roller 331 and the photosensitive drum 31 under each condition of the Asker C hardness of the development roller 331 and the spring load of the pressing spring 362. When focusing on the nip width under the condition where the image failure does not occur in Table 1 (the underlined area in Table 2), it is understood that the nip width is within a range of 550 to 700 μm.

As described above, the nip width suitable for ensuring a balance between the toner development performance and the cleaning performance exists, and it is necessary to set the pressing force (the spring load) capable of achieving the nip width. At this time, it is considered that the development roller 331 having a higher hardness has a smaller change in the nip width with respect to the change in the pressing force and has a higher robustness. When the pressing force is 3 N or less, the Asker C hardness of the development roller 33 is desirably set to 65° or more in consideration of the possibility that the drive input coupling to the development roller 331 may cause a misalignment when the drive force is input to the development part 33 and the tolerance of the spring load is about ±15%.

However, if the hardness is too high, the mechanical stress of the toner received at the nip area between the regulating blade 334 and the development roller 331 is increased, and the deterioration of the development performance of the toner is promoted. Therefore, the upper limit of the Asker C hardness is preferably 73°. Further, because the pressing force of 9 N or more causes the drive failure of the development roller 331 due to the excessive torque of the development part 33, the range of the pressing force is preferably 3 to 8 N.

Figure 7:
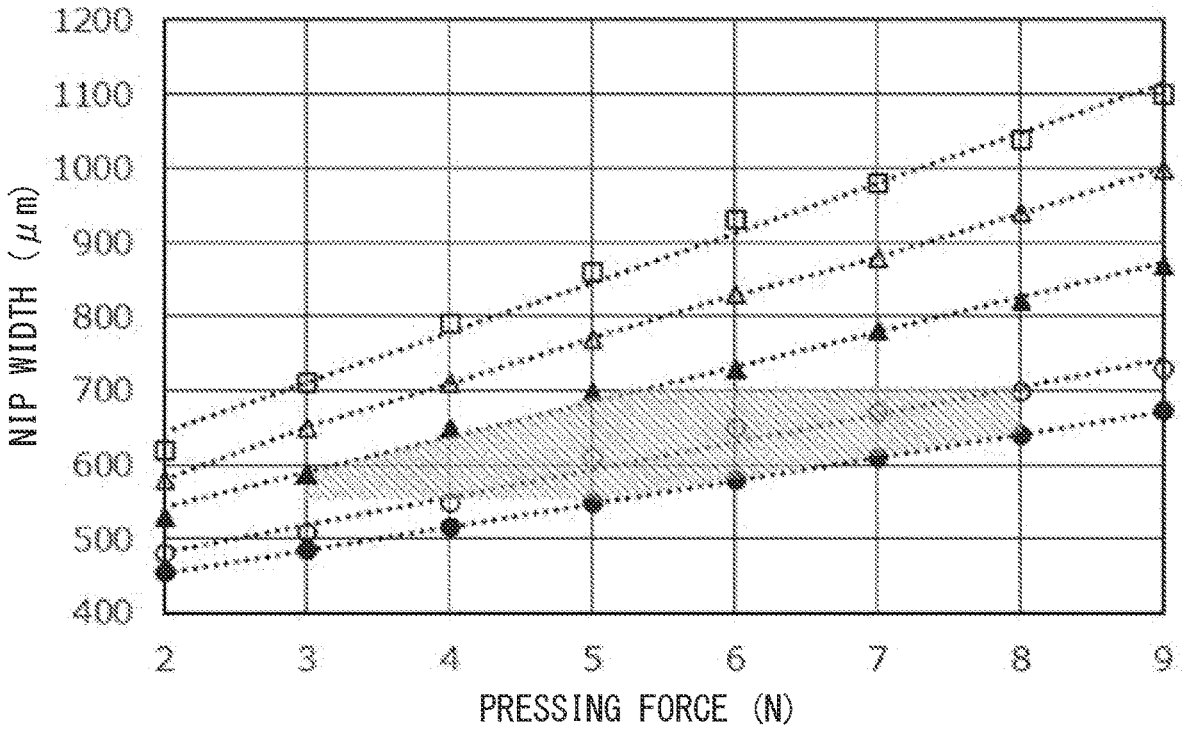
FIG. 7 is a graph showing a relationship between a pressing force of the development roller 331 and a nip width when a hardness of the development roller 331 is changed.

FIG. 7 is a graph showing a relationship between the pressing force of the development roller 331 and the nip width when the Asker C hardness of the development roller 331 is changed. In FIG. 7, a case where the Asker C hardness is 55° is represented by the data series of ● (an approximate straight line Y=31.0X+393.2), a case where the Asker C hardness is 60° is represented by the data series of ○ (an approximate straight line Y=36.9X+409.5), a case where the Asker C hardness is 65° is represented by the data series of ▲ (an approximate straight line Y=47.0X+450.1), a case where the Asker C hardness is 70° is represented by the data series of Δ (an approximate straight line Y=59.0X+470.2), and a case where the Asker C hardness is 73° is represented by the data series of □ (an approximate straight line Y=67.3X+508.8).

As shown in FIG. 7, when the X-axis shows the pressing force X [N] and the Y-axis shows the nip width Y [μm], the range (the hatched area in FIG. 7) where the image failure does not occur shown in Table 1 and Table 2 is a range where 3.0≤X≤8.0 and 550≤Y≤700, and is a range satisfying the following inequalities (1) and (2).

$$Y \geq 31.0X + 393.2, \quad (1)$$

$$Y \leq 47.0X + 450.1. \quad (2)$$

Conventionally, in the high hardness development roller 331 having the nip width of 2 mm or less, the nip pressure increases, and the contour of the dot image tends to become unclear. This disadvantage is caused by the fact that the toner is not collected by the development roller 331 while adhering to the non-exposed area on the photosensitive drum 31 corresponding to the white background area (the margin area), or that the toner once developed to a predetermined area on the photosensitive drum 31 is shifted in the development nip. Therefore, the above-described problem can be prevented by increasing the collection electric field (V0–Vdc) from the photosensitive drum 31 to the development roller 331.

Specifically, by setting the development voltage Vdc, the surface potential V0, and the surface potential VL after exposure within the ranges showing by the following inequalities (3) and (4), setting the collection electric field (V0–Vdc) to 2 times or more of the development electric field (Vdc–VL), and setting the development electric field (Vdc–VL) to 100 V or more, it becomes possible to obtain the clear dot image in the nip width of 550 to 700 μm described above.

$$V0 - Vdc \geq 2\,(Vdc - VL), \quad (3)$$

and $$Vdc - VL \geq 100. \quad (4)$$

Figure 8:
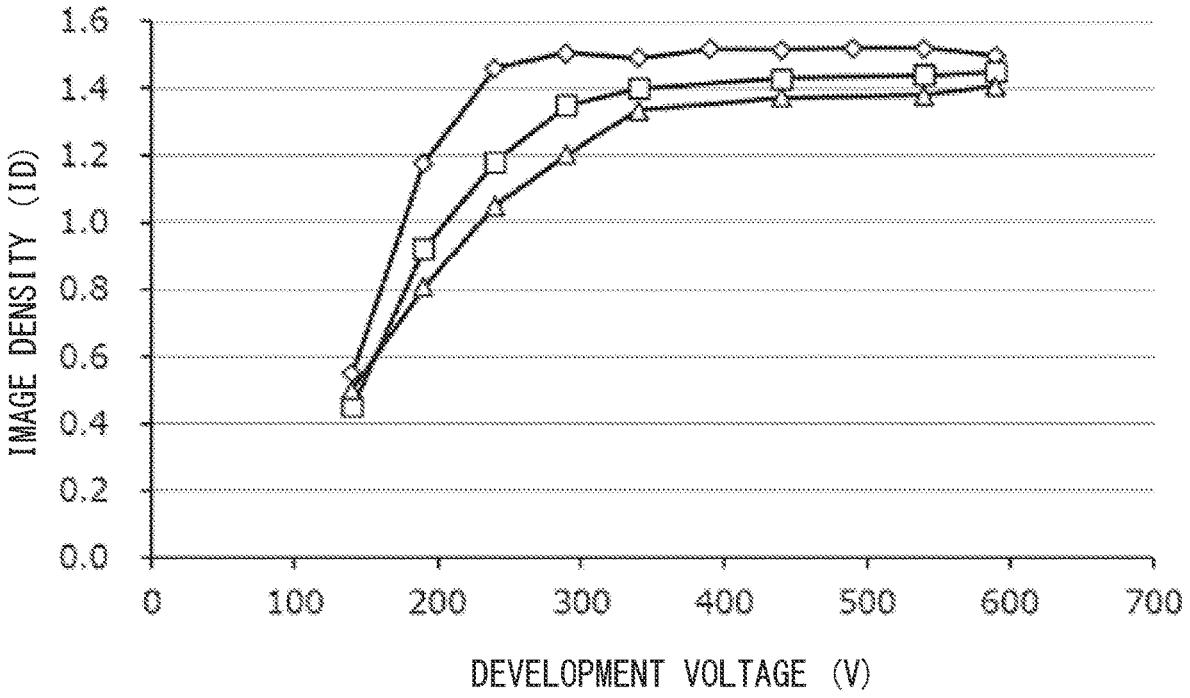
FIG. 8 is a graph showing a relationship between a development voltage applied to the development roller 331 and an image density when a surface free energy of the development roller 331 is changed.

(4. Another Structure) FIG. 8 is a graph showing a relationship between a development voltage applied to the development roller 331 and an image density (ID) when a surface free energy of the development roller 331 is changed. The surface free energy corresponds to a surface tension of a liquid in a solid, and corresponds to a molecular energy of the surface of the solid. In FIG. 8, a case where the surface free energy of the development roller 331 is 12 $mJ/m^2$ is represented by the data series of ◇, a case where the surface free energy is 21 $mJ/m^2$ is represented by the data series of □, and a case where the surface free energy is 30 $mJ/m^2$ is represented by the data series of Δ.

As shown in FIG. 8, a usable range OW of the development voltage tends to become narrower as the surface free energy of the development roller 331 increases. This is because, as the surface free energy of the development roller 331 increases, the upper limit value of the pressing force of the development roller 331, at which the white void occurs in the half-tone image, decreases. The surface free energy of the development roller 331 is preferably 5 $mj/m^2$ or more and 27 $mj/m^2$ or less.

An amount of the toner regulated by the regulating blade 334 also varies depending on a contact area ratio of the outer circumferential surface of the development roller 331. The contact area ratio of the outer circumferential surface of the development roller 331 is a ratio of the area of the outer circumferential surface of the development roller 331 excluding the concave area (the non-contact area) to the area of the outer circumferential surface of the development roller 331. That is, the contact area ratio of the outer circumferential surface of the development roller 331 shows a true contact area with respect to an apparent contact area between the outer circumferential surface of the development roller 331 and the regulating blade 334. The contact area ratio is preferably 4.5 to 10%, and more preferably 6 to 8%.

A regulating pressure of the regulating blade 334 is preferably 10 to 60 N/m, and more preferably 15 to 25 N/m. The producing method of the development roller 331 is not particularly limited, and the surface roughness of the development roller 331 may be adjusted by coating a coating layer containing particles or may be adjusted only by polishing.

In the present embodiment, the toner (the pulverized toner) produced by a pulverizing method is used, but the toner (the polymerized toner) produced by a polymerization method can also be used. The polymerized toner has a low adhesion force because of its true spherical shape having a high circularity, and has a wide usable range OW because of a good development performance. Therefore, the present disclosure is particularly effective in the non-magnetic one-component development system using the pulverized toner, which is more inexpensive than the polymerized toner.

In the present embodiment, the central particle diameter of the toner is 6.8 μm, but the results shown in Table 1, Table 2 and FIG. 7 confirm that the similar results can be obtained in the range of the central particle diameter of 6.0 to 8.0 μm. The reason for selecting the range of the central particle diameter is that the central particle diameter smaller than 6.0 μm leads to an increase in the producing cost of the toner, and the central particle diameter larger than 8.0 μm increases the toner consumption amount and deteriorates the fixing performance, which is undesirable.

In the present embodiment, the circularity of the toner is 0.96, but the results shown in Table 1, Table 2, and FIG. 7 confirm that the similar results are obtained in the range of circularity of 0.93 to 0.97. When the circularity is 0.93 or less, the image quality tends to deteriorate. When the circularity is 0.97 or more, the producing cost is significantly increased. Therefore, the both cases are not preferable.

Further, in the present embodiment, a polyester having a melt viscosity of 200,000 Pa·s at 90° C. was used as the main resin constituting the toner, but the results shown in Table 1, Table 2 and FIG. 7 confirm that the similar results can be obtained in the range of melt viscosity of 10,000 to 250,000 Pa·s at 90° C. When the melt viscosity is 250,000 Pa·s or more, the fixing performance of the toner deteriorates, which is undesirable from the viewpoint of energy saving.

For a linear velocity difference between the photosensitive drum 31 and the development roller 331, it is also confirmed that the similar result can be obtained in a range of 1.1 to 1.6 times (the surface velocity of the development roller 331 is higher than that of the photosensitive drum 31). When the linear velocity difference is smaller than 1.1 times, fogging in which the toner adheres to the white background area is generated, which is not preferable. On the other hand, if the linear velocity difference is 1.6 times or more, the driving torque and vibration of the development part 33 and the mechanical stress of the toner increase, and therefore it is not preferable from the viewpoint of the lifetime of the device.

Further, it is confirmed that the similar result can be obtained in the range where the surface potential V0 of the photosensitive drum 31 is 500 to 800 V and the surface potential VL after exposure is 70 to 200 V.

In addition, the present disclosure is not limited to the above embodiments, and various modifications can be made without departing from the spirit of the present disclosure. For example, although the monochrome printer has been described as an example of the image forming apparatus 1 in the above embodiment, it can also be applied to a tandem type or a rotary type color printer, for example. The present invention is also applicable to an image forming apparatus such as a copy machine, a facsimile machine, or a multi-function peripheral having these functions. However, they need to be provided with the photosensitive drum 31 and the development part 33 of the non-magnetic one-component development type.

Although the photosensitive drum 31 in the above embodiment uses a cylindrical raw tube as a support, a support of another shape may be used. The other shape may contain a plate shape or an endless belt shape. Further, although amorphous silicon is used as the photosensitive layer of the photosensitive drum 31 in the above embodiment, for example, the photosensitive drum may have a charge injection blocking layer for blocking injection of charges from the support.

The present disclosure is applicable to an image forming apparatus provided with a development device of a non-magnetic one-component development type using a non-magnetic toner. By utilizing the present disclosure, it is possible to provide an image forming apparatus capable of effectively suppressing the white void in the image or the cleaning failure in the non-magnetic one-component development type.

The invention claimed is:

1. An image forming apparatus comprising:

an image carrier having a surface on which a photosensitive layer is formed;

a charger which charges the image carrier at a predetermined surface potential;

an exposure device which exposes the surface of the image carrier charged by the charger and attenuates the surface potential to form an electrostatic latent image;

a development device including a development container, a developer carrier and a regulating blade, in which the development container contains a non-magnetic one-component developer consisting of a toner only, the developer carrier includes a roller part which carries the toner on an outer circumferential surface and a rotational shaft disposed along an axial center of the roller part, and is pressed on the image carrier with a predetermined pressing force to form a nip area between the roller part and the image carrier, the regulating blade comes into contact with the outer circumferential surface of the roller part of the developer carrier to regulate a thickness of a toner layer formed on the outer circumferential surface of the roller part, and the development device is configured to supply the toner to the image carrier on which the electrostatic latent image is formed; and a pressing mechanism which presses the development container close to the image carrier, wherein the roller part of the developer carrier has an Asker C hardness of 65° or more and 73° or less, and when the pressing force is set to X (N) and a width of the nip area in a circumferential direction of the image carrier is set to Y (μm), $3.0 \leq X \leq 8.0$ and $550 \leq Y \leq 700$, and the following expressions (1) and (2) are satisfied, $$Y \geq 31.0X + 393.2 \quad (1)$$

and, $$Y \leq 47.0X + 450.1. \quad (2)$$

2. The image forming apparatus according to claim 1, wherein when a development voltage applied to the developer carrier is set to Vdc, the surface potential of the image carrier is set to VL and the surface potential of the image carrier after exposure is set to VL, and the following expressions (3) and (4) are satisfied, $$V0 - Vdc \geq 2(Vdc - VL) \quad (3)$$

and, $$Vdc - VL \geq 100. \quad (4)$$

3. The image forming apparatus according to claim 1, wherein the developer carrier has a free surface energy of 5 $mj/mm^2$ or more to 27 $mj/mm^2$ or less.

4. The image forming apparatus according to claim 1, wherein the toner is a pulverized toner produced by a pulverizing method.

5. The image forming apparatus according to claim 1, wherein the toner has a central particle diameter of 6.0 to 8.0 μm.

6. The image forming apparatus according to claim 1, wherein the toner has a circularity of 0.93 to 0.97.

7. The image forming apparatus according to claim 1, wherein the toner has a melt viscosity of 10,000 to 250,000 Pa·s at 90° C.

8. the image forming apparatus according to claim 1, wherein the image carrier and the developer carrier are rotated in the same direction at the nip area.

9. The image forming apparatus according to claim 1, wherein a liner speed difference between the image carrier and the developer carrier is 1.1 to 1.6.

* * * * *